US005369856A

United States Patent [19]

Hauser

[11] Patent Number: 5,369,856

[45] Date of Patent: Dec. 6, 1994

[54] MARINE FASTENER

[76] Inventor: Hans Hauser, 10789 Waterfall Rd., Strongsville, Ohio 44136

[21] Appl. No.: 61,453

[22] Filed: May 17, 1993

[51] Int. Cl.[5] ..... A44B 17/00

[52] U.S. Cl. ..... 24/682; 24/110; 24/662; 411/270

[58] Field of Search ..... 24/682, 683, 662, 522, 24/523, 459, 94, 90 E, 110, 623; 411/270, 268, 266, 533, 348, 372, 554, 399

[56] References Cited

U.S. PATENT DOCUMENTS 1,047,782 12/1912 German ..... 24/662
1,484,807 2/1924 Baker et al. ..... 24/110
1,510,292 9/1924 Anderson ..... 24/110
1,563,350 12/1925 Field et al. ..... 24/110
1,564,657 12/1925 Wullum ..... 24/110
1,570,362 1/1926 Warner ..... 24/110
1,631,880 6/1927 Morton ..... 24/110
5,134,757 8/1992 Johnson ..... 24/682

*Primary Examiner*—Victor N. Sakran
*Attorney, Agent, or Firm*—Lightbody & Lucas

[57] ABSTRACT

A marine fastener is disclosed using a base plate, a retainer nut, the Jaw button, and a spring made of thermoplastic, with the inner back opening of the spring cooperating with a ridge on the outer opening of the jaw button in order to selectively bias the jaw button in respect to the base plate.

12 Claims, 2 Drawing Sheets

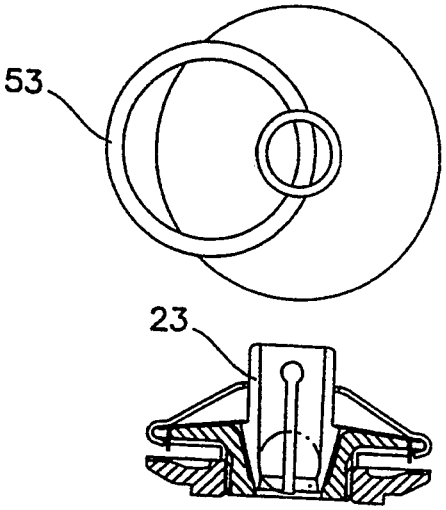
Fig.7
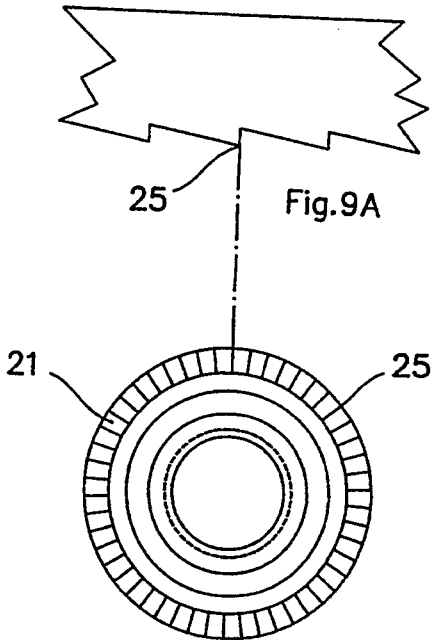
Fig.9A
Fig.9
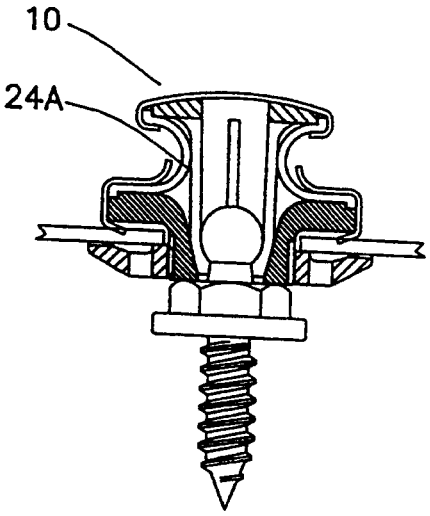
Fig.8
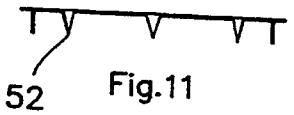
Fig.11
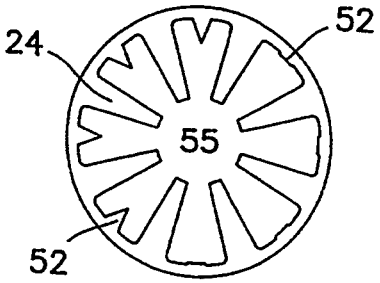
Fig.10

MARINE FASTENER

FIELD OF THE INVENTION

This invention relates to an improved fastener for use in applications including marine environments, convertible top closures, and other applications needing a selectively releasable ball type fastener.

BACKGROUND OF THE INVENTION

Ball type fasteners are not ordinarily used in the United States due to the preference for twist and wire ring type fasteners. A typical application for a ball fastener will be a snapped metal device used to hold the covers over convertible tops in their down position. Other applications include fastening a boat cover to the open cockpit of a boat, to join together two parts of a seal cover, and other applications. These prior art fasteners have short lives due to the harsh environment. The snaps typically are used together with the thinness of nickel plated brass normally used to make such fasteners.

OBJECTS OF THE INVENTION

It is an object of this invention to provide a low cost, high strength fastener.

It is an object of this invention to reduce the cost manufacturing fasteners.

It is an object of this invention to lengthen the service life of fasteners.

It is an object of this invention to simplify the manufacturing of fasteners.

It is an object of this invention to simplify the installation of fasteners.

It is an object of this invention to increase the number of applications for fasteners.

Other objects and a more complete understanding of the invention may be had by referring to the following drawings in which:

DRAWINGS

FIG. 7 is a cross-sectional view of an alternate pole ring female member;

FIG. 8 is a cross-sectional view of an alternate rubber spring female member.

FIG. 9 is a downward view of the retainer nut of FIG. 1 detailing the anti-rotation teeth with FIG. 9A an enlarged partial sectional view thereof;

FIG. 10 is a downward view of the diaphragm spring of fastener of FIG. 1; and, FIG. 11 is a side view of the diaphragm spring of FIG. 10.

DESCRIPTION OF THE PREFERRED EMBODIMENT

Figure 1:
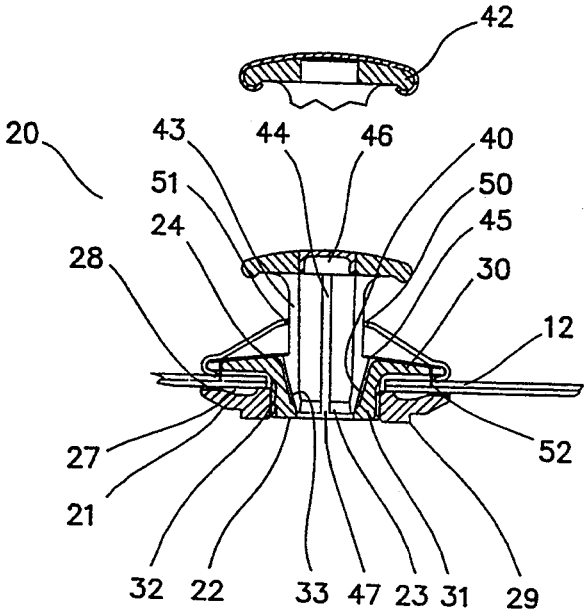
FIG. 1 is a cross-sectional view of a female fastener member incorporating the invention of the application.

This invention relates to an improved fastener. The invention will be described in its preferred embodiment of a ball type fastener for use in a marine environment.

The preferred fastener 10 disclosed includes a female member 20 and a male member 60.

The female member 20 is the receiving part of the fastener 10. The particular female member 20 disclosed includes a retainer nut 21, a base plate 22, a jaw-button 23, and a spring 24.

The retainer nut 21 cooperates with the base plate 22 in order to retain the female member 20 onto the physical object to which the female member 20 is interconnected. In the preferred embodiment, a piece of canvas, for example leather or vinyl 12. In this embodiment, one of the retainer nut 21 or the base plate 22 includes a part which passes through the matter being attached. In the particular embodiment disclosed, this is a circular section 31 (later described) which extends downward off the base plate 22. It is preferred that the retainer nut 21 have a relieved section 27 inwardly of its outer edge on the uppermost surface of the retainer nut 21. This relieved section 27 serves to concentrate the clamping forces between the retainer nut 21 and base plate 22 (later described) on the outer edge 28 of the retainer nut 21. This concentration of force holds the fabric 12 in place better than a flat surface would.

The outer edge 28 of the retainer nut 21 in FIG. 1 incorporates a series of angled ramps or teeth 25 increasing in the direction of rotation and terminating in straight sections in order to maintain the retainer nut 21 in a tightened position (FIG. 9). The ramps allow tightening while the straight sections bind against the canvas to hold the retainer nut 21 in position. Similar but reverse directed ramps or teeth 25 on the base plate 22 lock the base plate 22 in position in respect to the canvas. Alternate means to prevent rotation such as the teeth of FIG. 2 could also be utilized.

To facilitate the interconnection between the retainer nut 21 and the base plate 22, it is preferred that the retainer nut 21 incorporate some sort of means by which a tightening implement can be fixed to the retainer nut 21 for rotating said retainer nut. In the particular embodiment disclosed, this means is a hex head 29 formed in the bottom surface. This hex head 29 allows for a tool to be utilized to selectively rotate the retainer nut 21 to maximize the interconnection of the fastener 20 to the fabric 12. Other rotating means could be utilized if desired.

In the preferred embodiment disclosed, the retainer nut 21 is molded in a thermoplastic such as nylon. It has a diameter of 0.85", a thickness of 0.11", and a center hole threaded for a $\frac{3}{8}$-24 national fine interconnection. The hex head 29 is 0.50" across its flats. The relieve section 27 is relieved 0.027". The teeth 25 shown are each fifty in number angled at 11° with a depth of 0.010".

The base plate 22 cooperates with the jaw button 23 in order to selectively engage the ball of the male member 60. As previously discussed, the base plate 22 also cooperates with the retainer nut 21 in order to hold the fastener 20 onto the fabric 12. The base plate 22 in addition includes a flange 30 and an inner body 31.

The flange 30 serves a dual purpose of cooperating with the retainer nut 21 to interconnect the fastener 10 to the fabric 12 as previously discussed. The flange 30, in addition, serves as the mounting part for the spring 24 (later described).

The inner body 31 of the base plate 22 serves a dual purpose of interconnecting the base plate 22 to the retainer nut 21 (via the outer circumference of the inner body 31) while cooperating with the jaw button 23 in order to selectively capture the male member 60 (via the inner diameter of the inner body 31). To accomplish the former, the outer circumference 32 of the inner body 31 is designed to match the attachment means on the retainer nut 21, in this case threaded with ⅜-24 national fine threads. Other attachment means could be used as appropriate.

The inner circumference 33 of the inner body 31 is tapered. This tapering in combination with the corresponding taper on the jaw button 23 serves to allow the opening in the jaw button to be selectively expanded and/or contracted depending on the position of the jaw button 23 in respect to the base plate 22.

In the preferred embodiment disclosed, the base plate 22 as with the retainer nut 21 is made of thermoplastic, in this case nylon is the base plate 22 itself approximately 0.819" in diameter having an inner body 31 with an outer circumference 32 tapered for ⅜-24 national fine threads and an inner diameter 33 tapering at a 29.6° angle from a opening 0.197" in diameter. The teeth 25 are similar to that of the retainer nut 21. As with the retainer nut 21, is made of thermoplastic, in this case nylon.

The jaw button 23 is the main movable operative member for the fastener 20. The lower part of the jaw button 23 has a tapered section 40 which cooperates with the base plate 22 in order to selectively interconnect the male member 60 to the female member 20. Slots 44 extending longitudinally along the length of the body 43 of the jaw button 23 allow the tapered section 40 to expand and contract in order to capture the ball 61 of the male member therein when the tapered section 40 is seated on the inner circumference 33 of the base plate 22. The lower opening 47 of the tapered section 40 is thus selectively alterable from a diameter less than the male member to a diameter greater than the male member.

A ridge stop 45, in the preferred embodiment on the outer circumference of the tapered section 40, cooperates with the spring 24 (later described) in order to bias the tapered section of the jaw button 23 into physical contact with the inner circumference 33 of the base plate 22. This provides a default condition of a closed position for the lower opening 47 of the jaw button 23. Other stops could be used.

The body 43 of the jaw button 23 serves to interconnect the tapered section 40 to the button 42. The button 42 is the main operative interconnection for the fastener 20. The button 42 thus incorporates some way for a user to selectively manipulate the jaw button 23. In the embodiment of FIG. 1, this is an enlarged diameter button section. A ring (53 in FIG. 7) or other means can be utilized to manipulate the jaw button 23.

In the preferred embodiment disclosed, the jaw button 23 is again made of molded nylon. The lower opening 46 of the tapered section 40 of the jaw button has a diameter of 0.166", the slots are 0.030" wide with the entire jaw button 23 0.53" long. The outer circumference of the tapered section 40 is designed to match the taper of the inner circumference 33 of the base plate 22. An access opening 46 in the button 42 of the jaw button 23 allows for the simultaneous formation of the ridge 45 and the reduced neck of the tapered section 40 of the jaw button in a three piece die. This facilitates the manufacture of the female member 20.

The spring 24 serves to bias the jaw button 23 into a preferred position in respect to the base plate 22. In the embodiment disclosed, this is a closed position. The spring 24 accomplishes this by providing for a resilient tensioning force between the jaw button 23 and the base plate 22. In the embodiment of FIG. 1, this tensioning force is accomplished by a flat leaf spring engaging the ridge 45 of the jaw button 23. The spring 24 itself is held in position against the upper surface of the base plate 22 of the female member 20 by a crimp ring 50 which extends about the outer circumference of the base plate 22. Other methods attaching the leaf spring 24 to the base plate 22 could also be utilized. The use of a crimp ring 50 is preferred in that the crimp ring 50, in addition, serves to provide a physical stop for the outer position of the jaw button 23 as later described. This physical stop is provided by extending the inner section of the crimp ring 50 inwards to substantially adjoin the body 43 at the jaw button 23. Thus upon movement of the jaw-button 23 away from the base plate 22, the ridge 45 will eventually contact the inner opening 51 of the crimp ring 50. This will serve to prevent further motion of the jaw button 23 outwards. This simultaneously prevents over extension of the spring 24 while retaining the jaw button 23 into position in respect to the remainder of the fastener. In addition, the spring 24 in the preferred embodiment disclosed has slight teeth 52 which extend downwardly off of the outer circumference of the spring 24 (FIG. 11). These teeth 52 interengage the fabric 12 so as to prevent the fastener 20 from pulling out and also preventing the rotation of the base plate 22 in respect to such fabric. This facilitates attachment of the female member 20 to the fabric as well as aiding against subsequent detachment. This anti-rotation device could also be incorporated into the crimp ring, base plate, or other parts of the fastener 10.

In the preferred embodiment as shown in FIGS. 10 and 11, the leaf spring 24 is a stamped section having eight inwardly extending long prongs 55 off of an outer circumferential section and eight short prongs. The short prongs are bent downward at a 90° angle in order to create the teeth 52 (shown in both conditions in FIG. 10). The outer circumference of the spring is 0.788" in diameter with the inner opening of the long prongs having a diameter of substantially 0.259". The crimp ring 50 has an outer diameter of substantially 0.823", an inner diameter of substantially 0.260", and a height of substantially 0.14". The sides of the crimp ring 50 have a taper of substantially 119° in respect to each other.

Although the female member 20 has been described in its preferred embodiment with a certain degree of particularity, it is to be understood that numerous changes can be made without deviating from the invention. For example, if an elastomer spring is utilized between the base plate 22 and the jaw button 23, then a combination of stop and resilient force would be provided without the necessity of the crimp ring accomplishing this function. This is shown in FIG. 8. Alternately other springs could be utilized such as an external wire spring.

The male member 60 is the second part of the fastener 20. The male member 60 incorporates a ball 61, and a mounting means 71.

The ball 61 is a part which is designed to cooperate with the jaw button 23 of the female member 20 in order to selectively interconnect whatever is attached to the ball 61 to whatever is attached to the female member 20.

Figure 2:
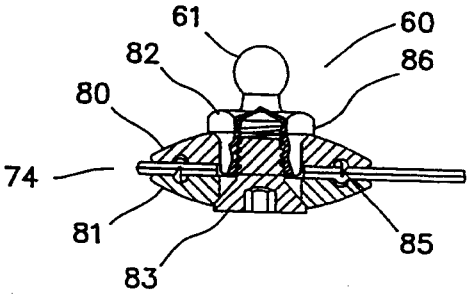
FIG. 2 is a cross-sectional view of a male member for use with the fastener of FIG. 1.
Figure 3:
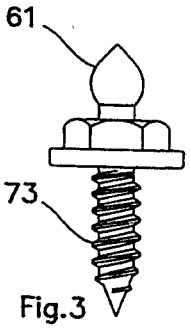
FIGS. 3–5 are alternate male members for use with the fastener of FIG. 1.

In the preferred embodiment, the ball 61 is a simple circular shape having an outer diameter of substantially 1.84". Although this simple circular shape is preferred, other shapes can be utilized as well. An example of this is the conical shape shown in FIG. 3 wherein the top section of the ball 22 is tapered at a 45° angle in respect to the center line. This taper provides for an easier insertion than with a simple circular shape as shown in FIG. 2. In both embodiments, it is preferred that the lower section of the ball 61 be at most circular so as to provide for a maximum interconnection force once fastened.

Figure 4:
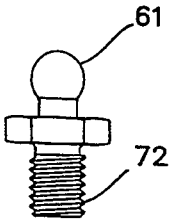

The mounting means 71 for the male member 60 serves to fixedly interconnect the ball 61 to the part which will be utilized with the male member 60. Due to the wide adaptability of the fastener 10, the mounting means 71 has a wider range of alternatives than the corresponding section in the female member 20. This includes a stud 72 (FIG. 4), a screw 73 (FIG. 3), and a mounting anchor 74 (FIG. 2). The stud 72 embodiment includes a threaded section approximately ¼" long having 10-24 national course threads thereon. A hex shaped section between the stud 72 and the ball 61 serves to fasten the stud 72 in position.

The screw 73 disclosed is a number 8-18 type such screw having a length of substantially ½". Again, a hex shaped head section is incorporated between the screw 73 and the ball 61 in order to selectively interconnect the screw with the associated part.

Figure 6:
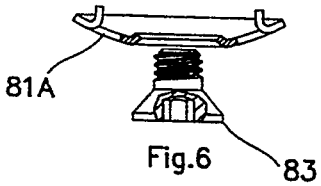
FIG. 6 is an alternate design for a male member similar to FIG. 2.

The anchor 74 can take many embodiments. This includes the threaded surface mounting screw adaptation shown in FIG. 5, the fabric anchor plastic version shown in FIG. 2, and the combination plastic/steel fabric anchor version shown in FIG. 6.

Figure 5:
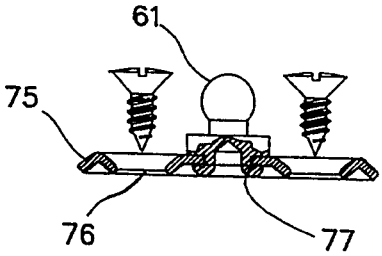

In the anchor base version of FIG. 5, a stamped steel anchor base 75 is designed having three concentric holes therein 76, 77. The first two holes 76 are used with wood screws in order to fasten the base 75 to the associated part. Note, however, that the base 75 could, for example, be riveted to fabric or otherwise utilized. The third hole 77 is used with a downwardly extending flange off of the ball 61 in order to rivet the ball 61 to the base 75. This is accomplished by having a downwardly protruding section of substantially 0.93" and 0.27" in diameter, which section is riveted over in order to engage the size of the hole 77 and thus anchor the ball 61 fixedly to the base 75. The hole 76 is substantially 0.164" in diameter with the central hole 0.161" in diameter. The anchor base itself is substantially 1" long and 0.44" wide.

The stud, screw, and anchor base embodiments are used to interconnect the ball 61 to a surface. Alternately, the ball 61 can be utilized with fabric or a thin material wherein a solid method is not possible. Under this circumstance, a anchor 74 could be utilized.

In the embodiment of FIG. 2, the anchor 74 includes an upper disc 80, a lower disc 81, a nut 82, and a screw 83.

The upper disc 80 is for utilization on one side of the material with the lower disc 81 utilized on the other side of the material. These discs serve to spread out any forces on the ball 61 over a greater extent than would be present without the discs. In the preferred embodiment disclosed, the upper disc 80 and lower disc 81 are substantially identical, each being some 0.75" in diameter with a 0.28" diameter center hole. Small teeth 85 are integrally formed in the bottom surface of the two discs so as to lock the discs to the material and prevent the fabric from pulling out.

The nut 82 is a threaded female section formed integrally with the ball 61. The nut 82 has an outer diameter substantially identical to the inner diameter of the two discs with a flange 86 located between the threaded portion and the ball 61. This flange serves to prevent the nut 82 from being pulled through the hole in the discs upon the tightening of the screw 83.

The screw 83 is utilized with the nut 82 in order to selectively interconnect the ball 61 to the anchor 74 and, in addition, to tightly hold the upper 80 and lower 81 discs against the intervening material. The screw 83 and nut 82 thus combine both an attachment and clamping function.

In the preferred embodiment disclosed, the upper 80 and lower 81 discs are formed of plastic and are substantially identical. Alternately, one, the other, or both can be replaced by a stamped steel member having the shape shown in FIG. 6.

Although the invention has been described in its preferred form with a certain degree of particularity, it is to be understood that numerous changes can be made without deviating from the invention as hereinafter claimed.

What is claimed is:

1. In a fastener having a base plate, a female jaw for capturing a ball of a male member therein, such jaw connected to a button and a spring between the base plate and jaw, the improvement of means for said jaw to expand and contract, the spring surrounding the jaw, said spring having an inner opening, said jaw having a stop open to its external surface, and said inner opening of said spring contacting said stop of said jaw so as to movably resiliently bias said jaw in a contracted condition.

2. The improved fastener of claim 1 characterized by the addition of a crimp ring, said crimp ring interconnecting said spring to the base plate.

3. The improved fastener of claim 2 wherein the base plate has a bottom surface and characterized in that said crimp ring has serrations, and said serrations of said crimp ring being located on the bottom surface of said base plate.

4. The improved fastener of claim 1 wherein the jaw has an open position spacing its said stop a certain distance in respect to the base plate and characterized in that said crimp ring has an inner opening, said inner opening of said crimp ring being spaced from the base plate substantially equal to the certain distance of said stop of the jaw and said stop of said jaw contacting said inner opening of said crimp ring in the open position of said jaw so as to stop said jaw at the open position.

5. The improved fastener of claim 3 wherein said inner opening of said spring has a diameter, said inner opening of said crimp ring has a second diameter, and said stop of the jaw has a third diameter, and said diameter, second diameter, and third diameter being substantially equal.

6. The improved fastener of claim 3 characterized in that said spring is interposed between said stop and said inner opening of said crimp ring.

7. The improved fastener of claim 1 wherein said spring is a leaf spring.

8. The improved fastener of claim 1 characterized in that said stop is a ridge, said ridge being formed on the external surface of said jaw.

9. The improved fastener of claim 6 characterized in that said inner opening of said spring has a diameter, said jaw has a diameter at the location of said ridge, and said diameter of said inner opening of said spring being substantially equal to said diameter of said jaw at said ridge.

10. The improved fastener of claim 6 characterized in that said inner opening of said spring has a diameter, said jaw has a diameter at the location of said stop ridge, and said diameter of said inner opening of said spring being substantially equal to said diameter of said jaw at said stop ridge.

11. In a fastener having a base plate a female jaw for capturing a ball of a male member therein, such jaw connected to a button and a spring between the base plate and jaw, the improvement of means for said jaw to expand and contract, the spring surrounding the jaw, said spring having an inner opening and surface, said jaw having a tapered section, said tapered section having a ridge stop on its external surface, means to connect said surface of said spring to the base plate, and said inner opening of said spring contacting said ridge stop of said tapered section of said jaw so as to movably resiliently bias said jaw in a contracted condition.

12. In a fastener having a base plate, a female jaw for capturing a ball of a male member therein, such jaw connected to a button and a spring between the base plate and jaw, the improvement of means for said jaw to expand and contract, the spring surrounding the jaw, said spring being a leaf spring having an inner opening and an outer edge, said jaw having a ridge stop open on its external surface, a crimp ring, said crimp ring interconnecting said outer edge of said spring to the base plate, said ridge stop of said jaw having an open position spaced a certain distance in respect to the base plate, said crimp ring having an inner opening, said inner opening of said crimp ring being spaced from the base plate substantially equal to the certain distance of said ridge stop of the jaw, said stop of said jaw contacting said inner opening of said crimp ring in the open position of said jaw so as to stop said jaw at the open position, said inner opening of said spring contacting said stop of said jaw so as to movably resiliently bias said jaw in a contracted condition.

* * * * *